US007419520B2

(12) United States Patent
Lee et al.

(10) Patent No.: US 7,419,520 B2
(45) Date of Patent: Sep. 2, 2008

(54) DUST COLLECTION UNIT AND VACUUM CLEANER WITH THE SAME

(75) Inventors: Chang Ook Lee, Daegu-si (KR); Jae Won Choi, Busan-si (KR)

(73) Assignee: LG Electronics Inc., Seoul (KR)

( * ) Notice: Subject to any disclaimer, the term of this patent is extended or adjusted under 35 U.S.C. 154(b) by 385 days.

(21) Appl. No.: 11/213,781

(22) Filed: Aug. 30, 2005

(65) Prior Publication Data

US 2006/0042202 A1 Mar. 2, 2006

(30) Foreign Application Priority Data

Aug. 31, 2004 (KR) ..... 10-2004-0068818
Oct. 29, 2004 (KR) ..... 10-2004-0087097

(51) Int. Cl.
*A47L 9/20* (2006.01)
*B08B 5/04* (2006.01)

(52) U.S. Cl. ..... 55/282; 55/283; 55/289; 55/DIG. 2; 55/DIG. 3; 15/347; 15/352; 15/353

(58) Field of Classification Search ..... 55/282, 55/283, 289, DIG. 2, DIG. 3; 15/347, 352, 15/353; 210/413
See application file for complete search history.

(56) References Cited

U.S. PATENT DOCUMENTS

| | | | | | |
|---|---|---|---|---|---|
| 3,145,164 | A * | 8/1964 | Johkman | ..... | 209/254 |
| 3,246,754 | A * | 4/1966 | Sackett | ..... | 209/316 |
| 4,214,878 | A * | 7/1980 | Weiss | ..... | 95/276 |
| 4,983,290 | A * | 1/1991 | Schumann | ..... | 210/413 |
| 6,625,845 | B2 | 9/2003 | Matsumoto et al. | | |

FOREIGN PATENT DOCUMENTS

| | | | | |
|---|---|---|---|---|
| DE | 970 604 | C | 10/1958 | |
| DE | 1 059 636 | B | 6/1959 | |
| EP | 1136028 | A2 * | 9/2001 | ..... 55/289 |
| FR | 2 558 712 | A1 | 8/1985 | |
| JP | 2003-38398 | A | 2/2003 | |
| WO | WO-02/38025 | A1 | 5/2002 | |

* cited by examiner

*Primary Examiner*—Duane Smith
*Assistant Examiner*—Minh-Chau T. Pham
(74) *Attorney, Agent, or Firm*—Birch, Stewart, Kolasch & Birch, LLP

(57) ABSTRACT

A dust collection unit for a vacuum cleaner includes a dust collection container for collecting foreign objects contained in air introduced therein, covers defining a top and bottom of the dust collection container, and a filter-cleaning unit having a plurality of brushes rotating around the porous filter unit to remove the foreign objects clogging the outer surface of the porous filter unit.

21 Claims, 3 Drawing Sheets

DUST COLLECTION UNIT AND VACUUM CLEANER WITH THE SAME

BACKGROUND OF THE INVENTION

1. Field of the Invention

The present invention relates to a vacuum cleaner, and particularly, to a dust collection unit for a vacuum cleaner, which can automatically remove foreign objects clogging the filter unit. More particularly, the present invention relates to a dust collection unit for a vacuum cleaner, which can efficiently remove foreign objects adhered to a surface of a porous filter unit while air passes through the dust collection unit and reduce noise generated during the cleaning of the porous filter unit.

2. Description of the Related Art

A vacuum cleanser is classified into a canister type and an upright type. The former includes a suction nozzle unit sucking air containing foreign object while moving along a floor, a main body with a unit for generating air suctioning force through the suction nozzle unit, a dust collection unit for filtering foreign object contained in the air sucked into the main body, and an operating unit mounted on the main body so that a user grasps the operating unit in use. The suction nozzle unit, the main body, the dust collection unit, and the operating unit are integrated in a single body. The latter includes a suction nozzle unit and a main body receiving a dust collection unit. The suction nozzle unit and the main body are provided in separated units. A flexible hose is provided to interconnect the suction unit and the main body. Therefore, the cleaning is performed while moving the suction nozzle unit in a state where the main body is fixed at a location.

That is, the dust collection unit includes a cylindrical dust collection container and upper and lower covers that defines a top and bottom of the dust collection container, respectively. A suction guide is formed on a portion of the dust collection container to suck outer air and an outlet guide is provided on another portion of the dust collection container to exhaust the air from which foreign objects are removed.

In addition, a filtering unit is provided on an inner surface of the dust collection container to filter off dirt particles among the foreign objects sucked into the dust collection container. The filter unit is classified into a cyclone type separating foreign objects having heavy self-weight in cyclone airflow and a porous filter type for filtering off foreign objects greater than a predetermined volume while air containing the foreign objects passes through a porous filter. In order to improve the foreign object removal efficiency, both of these two types of filter units are generally provided in the dust collection unit. That is, the porous type filter unit is installed in the cyclone type filter unit. Therefore, the relatively large-sized foreign objects are first filtered off by the cyclone type filter unit and the relatively small-sized foreign objects are secondary filtered off by the porous type filter unit.

The constitution and operation of the filter unit will be described in more detail hereinafter.

The cyclone type filter unit is provided in the dust collection container and the porous type filter unit is installed in the cyclone type filter unit. When the air is introduced into the dust collection unit, the air flows in cyclone pattern in the cyclone type filter unit. At this point, the foreign objects heavier than the air fall down to be stored a separated foreign object-storing chamber. The foreign objects that are not removed by the cyclone type filter unit are filtered off by the porous filter unit while the air passes through the porous filter unit.

At this point, dirt particles may clog the surface of the porous filter unit. When the amount of the dirt particles clogging the surface of the porous filter unit is increased, airflow resistance is increased to deteriorate the air suctioning force. Furthermore, the motor may be overloaded. When the dirt particles are tightly adhered to the surface of the porous filter unit, it is difficult to remove the same from the porous filter even when the cleaning operation is performed.

SUMMARY OF THE INVENTION

Accordingly, the present invention is directed to a dust collection unit and a vacuum cleaner with the same that substantially obviates one or more problems due to limitations and disadvantages of the related art.

An object of the present invention is to provide a dust collection unit of a vacuum cleaner, which can improve the dust removal efficiency and prevent the overload of a motor by providing a filter-cleaning unit on an outer surface of a filter unit for filtering off foreign objects contained in air introduced into a main body of the vacuum cleaner.

Another object of the present invention is to provide a dust collection unit of a vacuum cleaner, which can enhance cleaning efficiency of a filter-cleaning unit provided on an outer surface of a filter unit.

Still another object of the present invention is to provide a dust collection unit of a vacuum cleaner, which can attenuate noise generated during the operation of a filter-cleaning unit, thereby reducing unpleasant feeling of a user.

Still yet another object of the present invention is to provide a dust collection unit of a vacuum cleaner, which can improve dust collection efficiency and prevent the overload of a motor by preventing foreign object from excessively clogging an outer surface of the porous filter unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dust collection unit for a vacuum cleaner, including: a dust collection container for collecting foreign objects contained in air introduced therein; covers defining a top and bottom of the dust collection container; and a filter-cleaning unit having a plurality of brushes rotating around the porous filter unit to remove the foreign objects clogging the outer surface of the porous filter unit.

According to another aspect of the present invention, there is provided a dust collection for a vacuum cleaner, including: a dust collection container for collecting foreign objects contained in air introduced therein; a porous filter unit for filtering off the foreign objects in the dust collection container; and a filter-cleaning unit for removing the foreign objects clogging an outer surface of the porous filter unit by rotating around the porous filter unit, wherein the filter-cleaning unit comprises rotation guides formed on a top and bottom of the porous filter unit; a plurality of brush supports interconnecting the rotation guides; a plurality of brushes attached on inner surfaces of the brush supports; and blades alternatively disposed with the rotation guides and connected to the rotation guides.

According to still another aspect of the present invention, there is provided a dust collection unit for a vacuum cleaner, including: a dust collection container for collecting foreign objects contained in air introduced therein; covers defining a top and bottom of the dust collection container; a filter-cleaning unit having a plurality of brushes rotating around the porous filter unit to remove the foreign objects clogging the outer surface of the porous filter unit; and a noise-preventing pad formed between the filter-cleaning unit and the porous filter unit.

According to the present invention, since the foreign objects clogging the outer surface of the porous filter unit can be effectively removed, the air effectively flows, thereby improving the dust removal efficiency of the vacuum cleaner and preventing the overload of the motor.

In addition, since the noise that may be caused by a collision between components during the operation of the filter-cleaning unit is attenuated, the pleasant feeling can be provided for the user.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
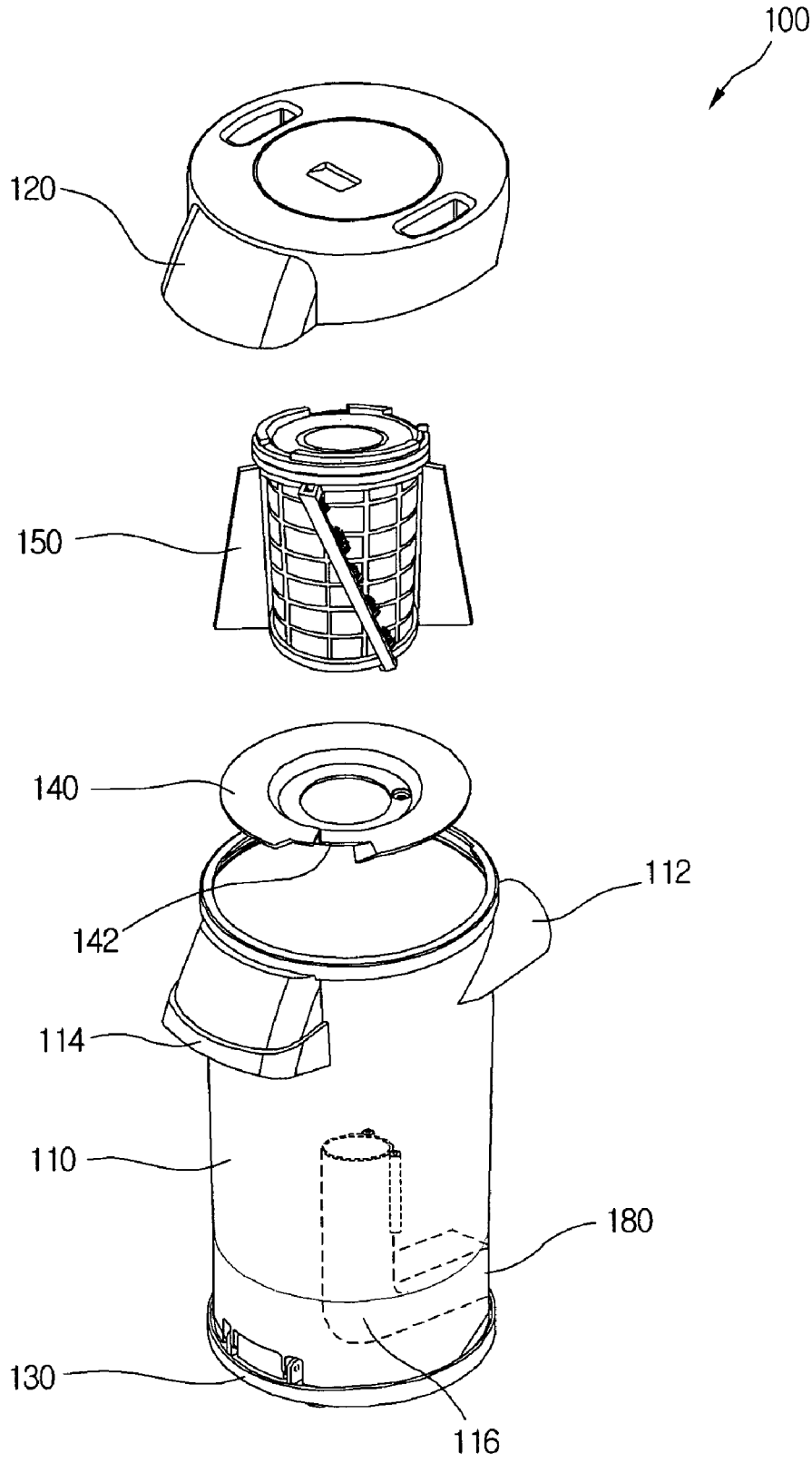
FIG. 1 is an exploded perspective view of a dust collection unit of a vacuum cleaner according to an embodiment of the present invention.

FIG. 1 shows a dust collection unit according to an embodiment of the present invention.

Referring to FIG. 1, the inventive vacuum cleaner includes a dust collection container 110 and upper and lower cover 120 defining a top and bottom of the dust collection container 110. A suction guide 112 is provided on a portion of an outer circumference of the dust collection container 110. The suction guide extends from the outer circumference of the dust collection container 110 to guide the air into the dust collection container 110 along an inner wall of the dust collection container 110 in a tangential direction. In addition, the suction guide 112 extends along an outer surface tangential line of the dust collection container 110. Therefore, cyclone airflow is generated in the dust collection container 110.

In addition, a handle 114 is formed on a portion of the outer circumference of the dust collection container 110, which is opposite to the portion where the suction guide 112 is formed. A bottom of the handle 114 is depressed upward so that the user can move the dust collection unit 100 using the handle 114.

In addition, a separation plate 140 is provided in the dust collection container 110 to divide an inner space of the dust collection container 110 into upper and lower chambers. The separation plate 140 is provided at an edge with a dropping portion 142 communicating the upper chamber with the lower chamber. The upper chamber functions as a foreign object removal chamber while the lower chamber functions as a foreign object-storing chamber. The foreign object removed by the foreign object-storing chamber and stored in the foreign object removal chamber cannot return to the foreign object removal chamber by the separation plate 140. The separation plate 140 further functions to prevent the cyclone airflow from being transmitted to the foreign object-storing chamber.

An air outlet guide tube 116 is provided in a lower portion of the dust collection container 110. The air outlet guide tube 116 is provided to guide the air purified by a porous filter unit 150 to a lower portion of the dust collection container 110. An air outlet 180 is provided on an extreme end of the air outlet guide tube 116 to exhaust the air directed along the air outlet guide tube 116 to an external side.

The porous filter unit 150 is provided between the upper cover 120 and the separation plate 140 to filter off dirt particles contained in the air. The porous filter unit 150 is fixed on an inner bottom of the upper cover 120. That is, the air that has passed through the cyclone filter unit further passes through the porous filter unit 150 so that the dirt particles contained therein can be filtered off by the porous filter unit 150.

The operation of the dust collection unit will be described hereinafter.

The air introduced through the suction guide 112 flows in a cyclone airflow pattern along the inner wall of the dust collection container 110. The foreign objects removed from the air by the cyclone airflow are stored in the foreign object-storing chamber (the lower chamber). At this point, since the cyclone airflow is not transmitted to the foreign object-storing chamber by the separation plate 140, the foreign objects stored in the foreign object-storing chamber cannot return to the foreign object removal chamber.

The air that has passed through the cyclone airflow further passes through the porous filter unit 150 so that the dirt particles contained therein can be filtered off by the porous filter unit 150. The air that has passed through the porous filter unit 150 is exhausted to the external side via the air outlet guide tube 116.

Meanwhile, a filter-cleaning unit (refer to the reference numeral 160 in FIG. 2) is formed around the porous filter unit 150 to remove the foreign objects that clog the surface of the porous filter unit 150 when the air passes through the porous filter unit 150. By the filter-cleaning unit, the foreign objects clogging the outer surface of the porous filter unit 150 can be removed. The filter-cleaning unit will be described in more detail hereinafter.

Figure 2:
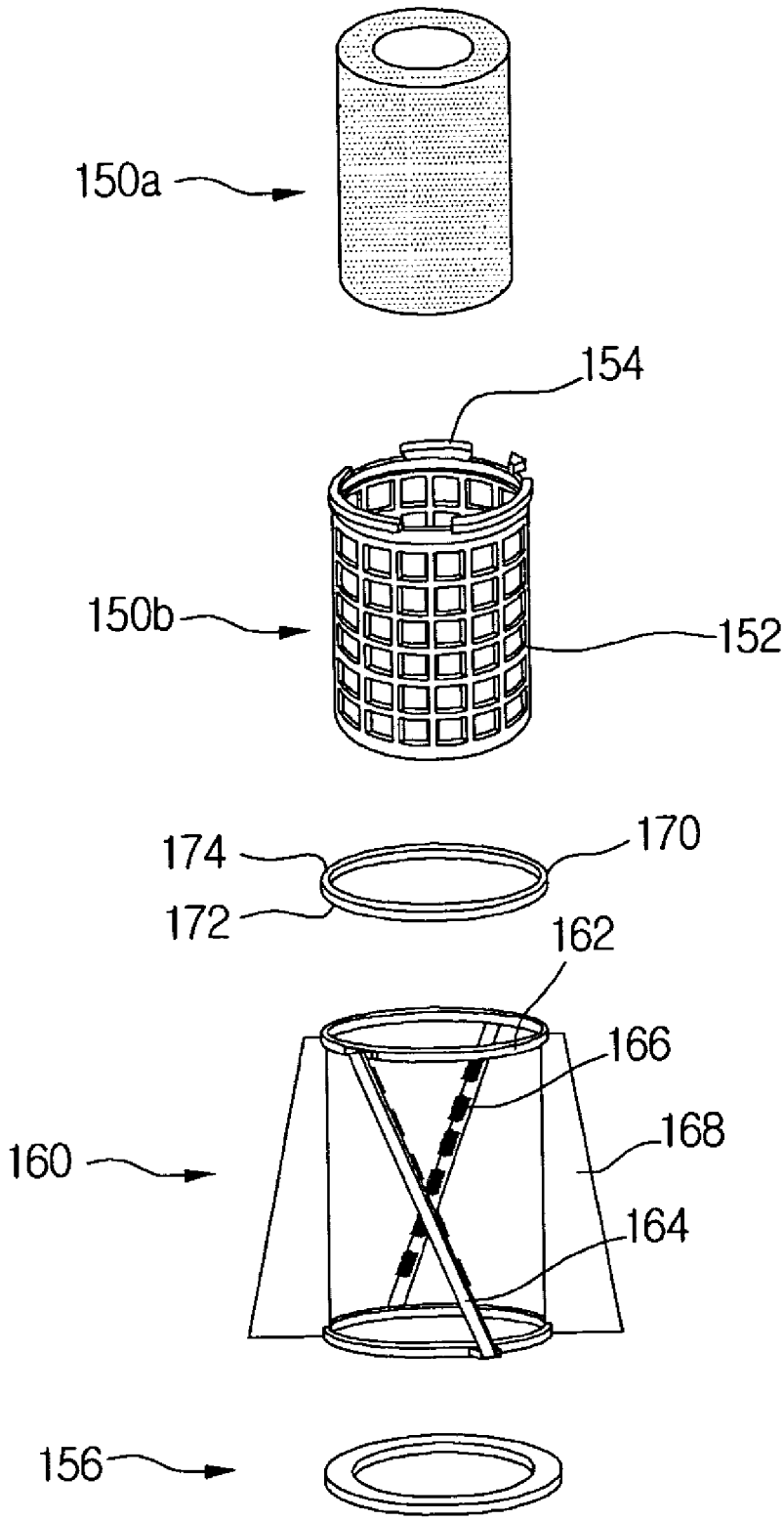
FIG. 2 is an exploded perspective view of a porous filter unit depicted in FIG. 1.

FIG. 2 shows the porous filter unit.

Referring to FIG. 2, the porous filter unit 150 includes an inner filter 150*a*, an outer filter 150*b*, and a filter-cleaning unit 160. The inner space of the porous filter unit 150 communicates with the air outlet guide tube 116 so that the air introduced into the filter unit 150 can be exhausted out of the dust collection unit 100 through the air outlet tube 116.

The inner filter 150*a* is formed in a hollow cylindrical shape and inserted in the outer filter 150*b*. The inner filter 150*a* may be formed of an air permeable material such as sponge to filter off the dirt particles that has passed through the outer filter 150*a*.

The outer filter 150*b* is formed in a cylindrical shape having an inner diameter slightly greater than an outer diameter of the inner filter 150*a*. A mesh filter 152 is disposed on an outer circumference of the outer filter 150*b*. Although the shape of the mesh filter 152 is depicted in detail in the drawing, it may be adhered to the outer circumference of the outer filter 150*b* by adhesive.

The outer filter 150*b* is provided at a top with a plurality of fixing projections 154 for fixing the porous filter unit 150 on the top cover 120. When the fixing projections 154 are coupled to the inner bottom of the top cover 120, the outer filter 150*b* is fixed on the inner bottom of the top cover 120 in a state where the inner filter 150*a* is received in the outer filter 150*b* so that the porous filter unit 150 can filter the foreign objects in the dust collection container 110.

A circular supporting plate 156 is provided on a bottom of the outer filter 150*b*. The supporting plate 156 functions to support the filter-cleaning unit 160 upward, thereby preventing the filter-cleaning unit 160 from being removed downward. The top surface of the supporting plate 156 may be smoothly processed so that no noise is generated when the filter-cleaning unit 160 rotates. A diameter of the supporting plate 156 is determined not to allow the filter-cleaning unit 160 to be removed downward and to be coupled to the outer filter 150*b*.

The filter-cleaning unit 160 is formed around the outer filter 150*b* to remove the foreign objects clogging the outer circumference of the outer filter 150*b*.

Figure 3:
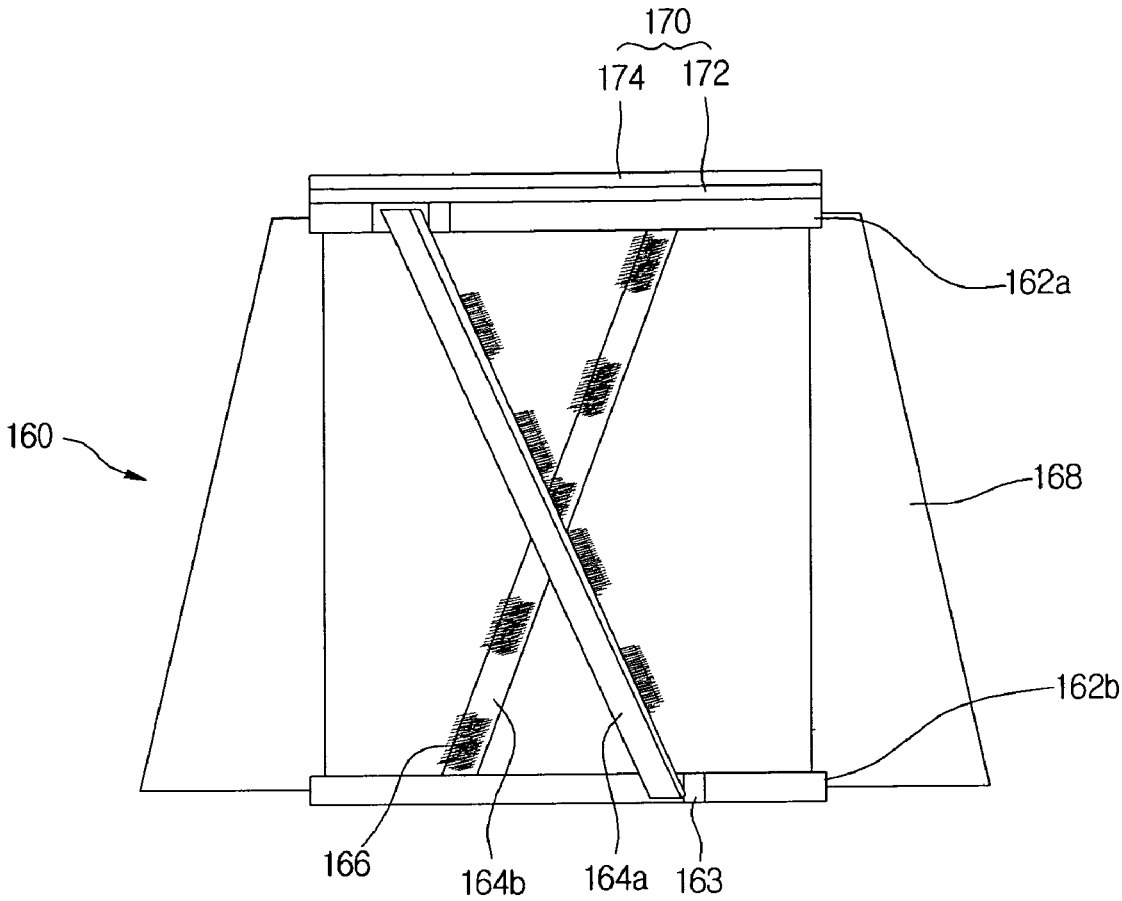
FIG. 3 is a perspective view of a filter-cleaning unit depicted in FIG. 2.

FIG. 3 shows the filter-cleaning unit.

Referring to FIG. 3, the filter-cleaning unit 160 is provided with a rotation guide unit 162 (see FIG. 2) spaced away from the top and bottom of the outer filter 150*b* to guide the rotation of the filter-cleaning unit 160 around the outer filter 150*b*. That is, as shown in FIG. 3, the rotation guide 162 include top and bottom rotation guides 162*a* and 162*b* that are identical in a diameter. Each of the rotation guides 162*a* and 162*b* has a geometrical center identical to that of the outer filter 150*b*. In addition, it is preferable that an inner diameter of each of the top and bottom rotation guides 162*a* and 162*b* is greater than the outer diameter of the outer filter 150*b* so that no interference between the filter-cleaning unit 160 and the outer filter 150*b* is incurred during the outer cleaning unit 160 rotates around the outer filter 150*b*. A plurality of connecting projections 163 are provided on outer circumferences of the rotation guides 162*a* and 162*b*. The connecting projections 163 are designed having a size that can allow a brush support unit 164 (see FIG. 2) to interconnect the top and bottom rotation guides 162*a* and 162*b* in a state where the brush support unit 164 is spaced away from the outer circumference of the outer filter 150*b*.

That is, as shown in FIG. 3, the brush support unit 164 includes first and second brush supports 164*a* and 164*b* each having opposite ends that are respectively coupled to each one of the connecting projections 163 formed on the top rotation guide 162*a* and each one of the connecting projections 163 formed on the bottom rotation guide 162*b* to interconnect the top and bottom rotation guides 162*a* and 162*b*. The first and second brush supports 164*a* and 164*b* are inclined, facing each other while crossing each other. That is, the first and second brush supports 164*a* and 164*b* function to support the top and bottom rotation guides 162*a* and 162*b*.

A plurality of brushes 166 are provided on inner surfaces of the first and second brush supports 164*a* and 164*b*. Each of the brushes 166 has a first end fixed on the inner surface of the corresponding brush support 164*a* (or 164*b*) and a second end contacting the outer circumference of the outer filter 150*b*. As a result, the brushes 166 removes the foreign objects clogging the outer circumference of the outer filter 150*b*. The brushes 166 attached on each of the first and second brush supports 164*a* and 164*b* are arranged in a zigzag shape so that the brushes 166 can brush the entire outer circumference of the outer filter 150*b* when the filter-cleaning unit 160 rotates, thereby more effectively removing the foreign objects clogging the outer circumference of the outer filter 150*b*. The brushes 166 are discontinuously provided so that the foreign objects removed by the brushes 166 can get out through spaces between the brushes 166. More preferably, portions of the first brush support 164*a*, which face the brushes attached on the second brush support 164*b*, are not provided with the brushes 166, thereby completely brushing the entire outer surface of the outer filter 150*b*.

Furthermore, since the first and second brush supports 164*a* and 164*b* are symmetrically disposed with respect to the rotational center, the cleaning reliability can be improved. In addition, the first and second brush supports 164*a* and 164*b* are inclined such that upper portions thereof are first advanced with respect to the rotational direction of the filter-cleaning unit 160. Therefore, the foreign objects brushed by the brushes 166 are directed downward and the area of the outer filter 150*b*, which contacts the brushes 166, can be enlarged. In addition, the first and second brush supports 164 function to guide the shape of the filter-cleaning unit 160.

Blades 168 are provided between the top and bottom rotation guides 162*a* and 162*b*. The blades 168 are projected outward to rotate the filter-cleaning unit 160 by airflow. That is, the blades 168 rotate by rotational force generated when the air introduced through the suction guide 112 formed on the dust collection container 110 rotates along the inner circumference of the dust collection container 110.

The blades 168 and the brush supports 164*a* and 164*b* are alternately formed. That is, one of the blades 168 is disposed adjacent to corresponding one of the brush supports 164*a* and 164*b*. Likewise the brush supports 164*a* and 164*b*, the blades 168 are symmetrically disposed with respect to the geometrical rotational center. Therefore, since the force generated by the introduced air is uniformly applied to the blades 168, force for the vertical and advancing movements of the filter-cleaning unit 160 is reduced. As a result, the noise can be reduced when the filter-cleaning unit 160 rotates. Widths of the blades 168 are gradually reduced as they go upward so as to lower the generation of the turbulent airflow of air whose foreign objects are not removed as being located on an upper portion. As a result, the cyclone airflow are into interfered by the filter-cleaning unit 160.

A noise-preventing pad 170 having a predetermined thickness is formed on a top surface of the top rotation guide 162*a* between the top of the filter-cleaning unit 160 and the outer filter 150*b*. The noise-preventing pad 170 includes an attaching member 172 attached on the top surface of the top rotation guide 162*a* and a contacting member 174 formed on the attaching member 172 to sliding-contact a surface of the outer filter 150*b* when the filter-cleaning unit 160. The attaching and contacting members 172 and 174 may be formed of elastic material so that they can be restored to their initial shapes even when the filter-cleaning unit 160 contacts the bottom of the fixing projections 154, thereby reducing the friction and noise. Furthermore, in order to reduce the friction, the contacting surface 174 is slippery processed.

When too many brushes 166 are provided, the frictional force between the brushes 166 and the outer circumference of the outer filter 150*b* is increased to reduce the rotational force of the filter-cleaning unit 160. In this case, the foreign objects are excessively adhered to the brushes 166. When the brush 166 is provided in a single body, the removal efficiency of the foreign objects is deteriorated and vibration is increased since the rotational center of the filter-cleaning unit 160 does not coincide with a weight center of the filter-cleaning unit 160.

The operation of the filter-cleaning unit 160 for removing the foreign object clogging the outer circumference of the outer filter 150*b* will be described with reference to FIG. 1.

When the vacuum cleaner is operated, the air containing the foreign objects is introduced into the dust collection container 110 through the suction guide 112 and the introduced air rotates along the inner circumference of the dust collection container 110.

Relatively heavy foreign objects among the foreign objects contained in the introduced air falls down by their self-weight and are collected under the separation plate. In addition, the dirt particles are filtered off by the mesh filer 152 while the air passes through the porous filter unit 150. At this point, foreign object that is lightweight but has a relatively large volume cannot falls down but clogs the mesh filter 152 while circulating around the outer filter.

Meanwhile, the blades 168 rotate the filter-cleaning unit 160 by receiving force of the airflow in the dust collection container 110. As the filter-cleaning unit 160 rotates, the foreign objects clogging the outer circumference of the mesh filter 152 are removed from the mesh filter 152 by the brushes 166 and dropt down.

At this point, the noise-preventing pad 170 attached on the top of the top rotation guide 162*a* rotates together with the rotation of the filter-cleaning unit 160. Therefore, the contacting member 174 minimizes the friction with the bottom of the fixing projections 154, thereby reducing the noise that may be caused by the friction.

According to the present invention, since the filter-cleaning unit is provided around the porous filter unit, the foreign objects clogging the outer surface of the porous filter unit can be effectively removed.

By removing the foreign objects from the outer circumference of the porous filter unit, the overload of the motor and the deterioration of the dust collection efficiency can be prevented.

In addition, since the noise-preventing pad is provided, the noise that may be caused by the friction generated when the filter-cleaning unit rotates can be reduced and the frictional resistance can be also reduced.

It will be apparent to those skilled in the art that various modifications and variations can be made in the present invention. Thus, it is intended that the present invention covers the modifications and variations of this invention provided they come within the scope of the appended claims and their equivalents.

For example, the noise-preventing pad 160 may be further provided on a bottom of the filter-cleaning unit 160. As a result, the noise-preventing pad 160 provided on the top of the filter-cleaning unit 160 prevents the noise that is caused when the filter-cleaning unit 160 is lifted upward by the rotation of the blades 168. In addition, the noise-preventing pad provided on the top of the filter-cleaning unit 160 prevents the noise that is caused when the filter-cleaning unit 160 is descended, thereby more effectively reducing the noise generated by the filter-cleaning unit 160.

In addition, although the blades and the brush supports are symmetrically disposed with respect to the geometrical rotational center, the present invention is not limited to this case. That is, as far as the blades and the brush supports are provided at an equal distance from the rotational centers thereof, the rotation of the filter-cleaning unit can be reliably realized.

What is claimed is:

1. A dust collection unit for a vacuum cleaner, comprising:

a dust collection container configured to collect foreign objects contained in air introduced therein;

a porous filter unit configured to filter off the foreign objects in the dust collection container;

covers defining a top and bottom of the dust collection container; and a filter-cleaning unit having:

a plurality of brushes configured to rotate around the porous filter unit to remove the foreign objects clogging the outer surface of the porous filter unit;

top and bottom rotation guides defining top and bottom portions of the filter-cleaning unit; and a rotation unit configured to provide a rotational force to rotate the plurality of brushes around the porous filter unit, the rotation unit including blades connected to the top and bottom rotation guides to provide the rotational force, wherein the blades extend from the top rotation guide to the bottom rotation guide.

2. The dust collection unit according to claim 1, wherein the filter-cleaning unit further comprises brush supports configured to support the rotation guides, the brushes being attached on the brush supports.

3. The dust collection unit according to claim 2, wherein the brush supports are inclined such that upper portions of the brush supports are closer to an advancing direction of the brushes.

4. The dust collection unit according to claim 2, wherein the blades provide the rotational force using airflow, the blades being mounted at a rotational center identical to that of the brushes.

5. The dust collection unit according to claim 2, wherein the brush supports are symmetrically disposed with respect to a geometrical rotational center.

6. The dust collection unit according to claim 2, wherein the brushes are discontinuously provided on the brush supports.

7. The dust collection unit according to claim 2, wherein the brush supports are provided by two in number.

8. The dust collection unit according to claim 2, wherein portions of one of the brush supports, which face the brushes attached on the other of the brush supports, are not provided with the brushes.

9. The dust collection unit according to claim 1, wherein the filter-cleaning unit is configured to rotate by cyclone airflow generated in the dust collection container.

10. A dust collection for a vacuum cleaner, comprising:

a dust collection container configured to collect foreign objects contained in air introduced therein;

a porous filter unit configured to filter off the foreign objects in the dust collection container; and a filter-cleaning unit configured to remove the foreign objects clogging an outer surface of the porous filter unit by rotating around the porous filter unit, wherein the filter-cleaning unit comprises:

top and bottom rotation guides formed on a top and bottom of the porous filter unit;

a plurality of brush supports interconnecting the top and bottom rotation guides;

a plurality of brushes attached on inner surfaces of the brush supports; and blades alternatively disposed with the ton and bottom rotation guides and connected to the top and bottom rotation guides to provide a rotational force to rotate the plurality of brush supports, wherein the blades extend from the top rotation guide to the bottom rotation guide.

11. The dust collection unit according to claim 10, wherein the brush supports and the blades are provided by two in number.

12. The dust collection unit according to claim 10, wherein each of the blades is reduced in a width as it goes upward.

13. The dust collection unit according to claim 10, wherein the blades and/or the brush supports are arranged at an equal distance from a rotational center.

14. The vacuum cleaner according to claim 10, wherein the blades are vertically disposed.

15. The vacuum cleaner according to claim 10, wherein portions of one of the brush supports, which face the brushes attached on the other of the brush supports, are not provided with the brushes.

16. The vacuum cleaner according to claim 10, further comprising a noise-preventing pad provided between the top and bottom rotation guides and the porous filter unit.

17. A dust collection unit for a vacuum cleaner, comprising:

a dust collection container configured to collect foreign objects contained in air introduced therein;

a porous filter unit configured to filter off the foreign objects in the dust collection container;

covers defining a top and bottom of the dust collection container;

a filter-cleaning unit having:

top and bottom rotation guides formed on a ton and bottom of the porous filter unit;

a plurality of brushes configured to rotate around the porous filter unit to remove the foreign objects clogging the outer surface of the porous filter unit;

a rotation unit configured to provide a rotational force to rotate the plurality of brushes around the porous filter unit, the rotation unit including blades connected to the top and bottom rotation guides to provide the rotational force; and a noise-preventing pad formed between the filter-cleaning unit and the porous filter unit, wherein the blades extend from the top rotation guide to the bottom rotation guide.

18. The dust collection unit according to claim 17, wherein the noise-preventing pad is fixed on the filter-cleaning unit.

19. The dust collection unit according to claim 17, wherein the noise-preventing unit is formed of an elastic material.

20. The dust collection unit according to claim 17, further comprising a supporting plate fixed on a lower portion of the porous filter unit to support the lower portion of the filter-cleaning unit.

21. The dust collection unit according to claim 17, wherein the noise-preventing pad is formed on a top of the filter-cleaning unit.

* * * * *